US005772844A

United States Patent [19]

Kappel et al.

[11] Patent Number: 5,772,844

[45] Date of Patent: Jun. 30, 1998

[54] PROCESS DISTRIBUTING FLUFFED PULP INTO A STATIC BED REACTOR FOR GASEOUS TREATMENT

[75] Inventors: Johannes Kappel, Graz; Peter Scheucher, Kumberg, both of Austria

[73] Assignee: Andritz-Patentverwaltungs-Gesellschaft m.b.H., Graz, Austria

[21] Appl. No.: 549,550

[22] Filed: Oct. 27, 1995

[30] Foreign Application Priority Data

Mar. 10, 1995 [AT] Austria ..... 420/95

[51] Int. Cl.[6] ..... D21C 7/06

[52] U.S. Cl. ..... 162/24; 162/52; 162/63; 162/65; 162/246

[58] Field of Search ..... 162/65, 237, 246, 162/52, 63, 19, 17, 24

[56] References Cited

U.S. PATENT DOCUMENTS

| | | | |
|---|---|---|---|
| 1,891,957 | 12/1932 | Smith | 162/246 |
| 1,998,875 | 4/1935 | Koda | 162/52 |
| 3,130,119 | 4/1964 | Carlsmith | 162/246 |
| 3,326,235 | 6/1967 | Jones | 162/246 |
| 3,814,664 | 6/1974 | Carlsmith | 162/236 |
| 4,123,317 | 10/1978 | Fritzvold et al. | 162/17 |
| 4,177,105 | 12/1979 | Laakso et al. | 162/65 |
| 4,278,496 | 7/1981 | Fritzvold | 162/65 |
| 4,279,694 | 7/1981 | Fritzvold et al. | 162/28 |
| 4,411,633 | 10/1983 | Phillips et al. | 162/65 |
| 5,164,043 | 11/1992 | Griggs et al. | 162/65 |
| 5,314,583 | 5/1994 | Kappel | 162/25 |
| 5,411,633 | 5/1995 | Phillips et al. | 162/65 |

FOREIGN PATENT DOCUMENTS 9247713 12/1994 WIPO .

OTHER PUBLICATIONS

Perkins et al, "Advances in Ozone Bleaching—Paper III", pp. 263–266.

"Importance of Reactor Design in High Consistency Ozone Bleaching", White et al, 79th Annual Meeting Canadian Pulp and Paper Assoc., Jan. 28, 1993.

*Primary Examiner*—Steven Alvo

*Attorney, Agent, or Firm*—Roylance, Abrams, Berdo & Goodman, L.L.P.

[57] ABSTRACT

A process and apparatus for treating and particularly bleaching pulp contacts a pulp with a gaseous reaction medium in a reactor tower. The pulp is fluffed and refined before being added to the pulp bed and then homogeneously permeated with the gaseous reaction medium to produce a uniformly treated pulp. A distribution device is included in the reactor to uniformly distribute the pulp in the reactor and form a homogenous pulp bed having a substantially even upper surface and uniform bed depth.

19 Claims, 6 Drawing Sheets

PROCESS DISTRIBUTING FLUFFED PULP INTO A STATIC BED REACTOR FOR GASEOUS TREATMENT

FIELD OF THE INVENTION

The present invention is directed to a process and apparatus for the treatment of various types of pulps, preferably high-consistency pulps, using a gaseous reaction medium. More particularly, the present invention is directed to a process and apparatus for the uniform bleaching of pulps and particularly high consistency pulp using ozone.

BACKGROUND OF THE INVENTION

In the field of pulp treatment using a gaseous reaction medium, bleaching is of particular interest. In the past few years, a bleaching process was developed using an ozone step in combination with an oxygen bleaching step. A particularly beneficial variant of this process is high-consistency ozone bleaching. Consequently, various different processes for treatment of pulps are previously known. One of these processes is described in U.S. Pat. No. 3,814,664 and U.S. Pat. No. 3,964,962 to Carlsmith. Other processes for ozone bleaching of pulp are disclosed in U.S. Pat. No. 4,278,496 and U.S. Pat. No. 4,279,694 to Fritzvold. In these processes, pulp is placed in a tower and permeated by a gaseous medium such as oxygen or ozone. These processes, however, have not received general acceptance, primarily due to the random and poor bleaching results achieved.

In an effort to improve the bleaching results, various tests were conducted using a horizontal dynamic reactor upstream of the static bleaching tower in order to achieve more thorough mixing of the pulp with the oxygen or ozone bleaching agent. Examples of this type of process are described in EP 0 106 460 and U.S. Pat. No. 5,174,861. These processes and devices, however, also did not provide satisfactory bleaching results. In particular, the abovenoted processes result in non-homogenous bleaching of the pulp as reported in "Importance of Reactor Design in High Consistency Ozone Bleaching" by White, Gandek, Pikulin and Friend (79th Annual Meeting CPPA).

SUMMARY OF THE INVENTION

A primary objective of the invention is to provide a process and apparatus for homogeneously and uniformly bleaching pulp without degrading or destroying the pulp fibers.

A further object of the invention is to provide a process and apparatus for treating pulp with a gaseous reaction medium by fluffing or refining the pulp before introducing to the pulp bed and thereafter homogeneously permeating the pulp bed with the gaseous reaction medium.

Another object of the invention is to provide a process and apparatus for uniformly and homogeneously bleaching pulp with ozone in a static bed of fluffed or refined pulp.

Still another object of the invention is to provide a process and apparatus for uniformly bleaching pulp with ozone in an efficient and economical manner.

The objects of the invention are basically attained by providing a process for treating pulp with a gaseous reaction medium comprising the steps of feeding a gaseous reaction medium and a pulp to a fluffer and passing said gaseous reaction medium and pulp in admixture through a fluffing zone in said reactor to produce a partially reacted fluffed pulp, discharging said fluffed pulp into a pulp static bed reactor and distributing said pulp substantially uniformly in said reactor to form a pulp bed having a substantially uniform and homogeneous upper surface and bed depth, said reactor having a distribution means for distributing said fluffed pulp substantially uniformly across the entire diameter of said reactor and upper surface of said pulp bed, and passing a gaseous reaction medium uniformly through the pulp bed.

The objects of the invention are further attained by an apparatus for treating pulp with a gaseous reaction medium, comprising a fluffer having a pulp inlet and a comminuting zone for receiving a mixture of pulp and a gaseous reaction medium and for fluffing and refining the pulp in the presence of said gaseous reaction medium to produce a partially reacted pulp, a pulp static bed reactor having an inlet positioned below the fluffer for receiving the fluffed and refined pulp and gaseous reaction medium directly from the fluffer, said reactor having a pulp outlet at a lower end thereof, distribution means disposed in the reactor and spaced below the inlet for substantially uniformly distributing the pulp across the diameter of the reactor and forming a substantially uniform and homogeneous pulp bed having a substantially uniform upper surface and bed height, and means for introducing a gaseous reaction medium into the reactor and passing the gaseous reaction medium through the pulp bed.

Other objects, advantages and salient features of the invention will become apparent from the following detailed description which, taken in conjunction with the annexed drawings, disclose preferred embodiments of the invention.

BRIEF DESCRIPTION OF THE DRAWINGS

Referring to the drawings which form a part of this original disclosure in which.

DETAILED DESCRIPTION OF THE INVENTION

Figure 1:
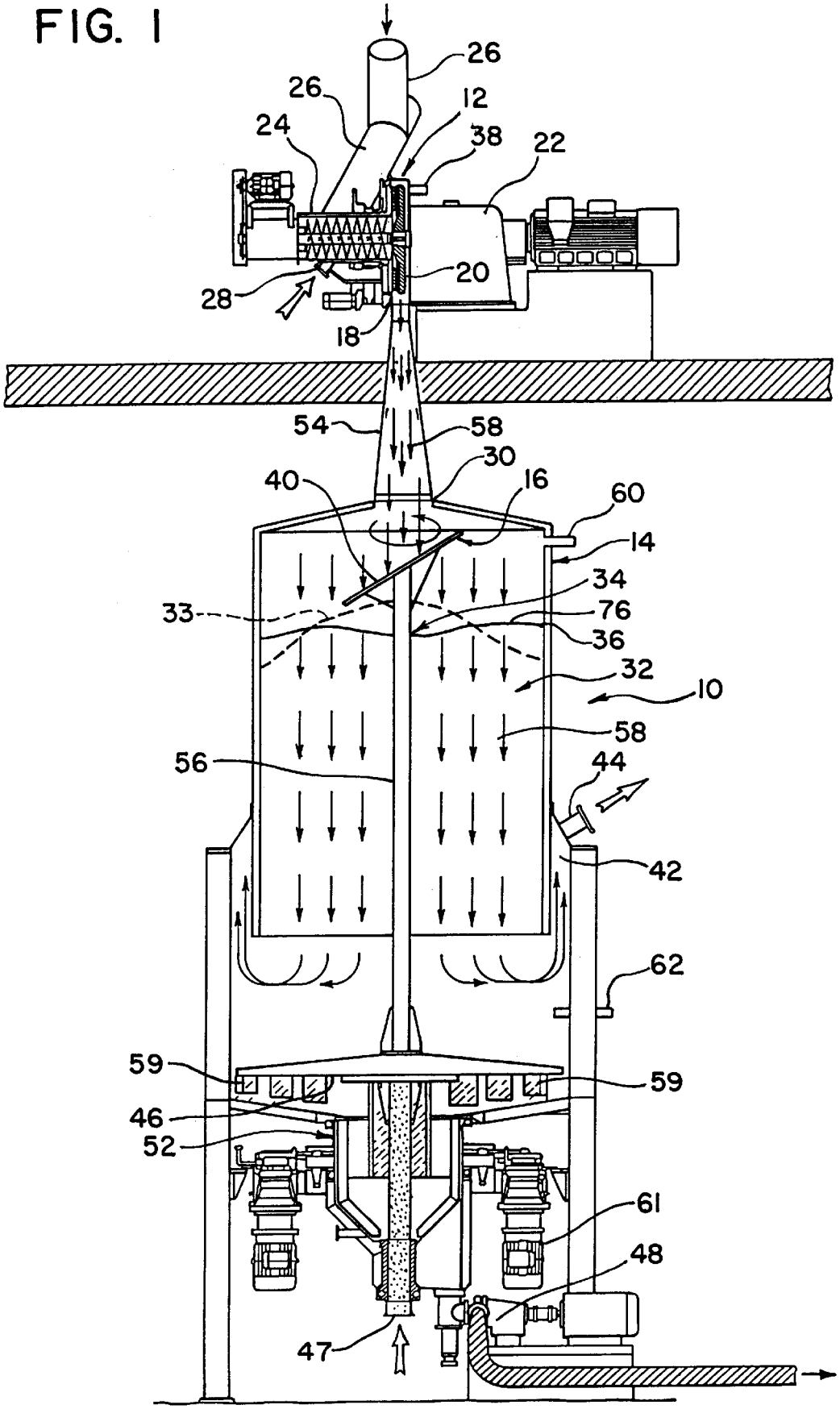
FIG. 1 is a cross-sectional side view of the fluffer and reactor showing the rotating distributing device in a first embodiment.

The present invention is directed to a process and apparatus for uniformly treating a pulp with a gaseous reaction medium. The invention is further directed to a process and apparatus for producing a uniformly bleached pulp using ozone as the reaction medium. The uniform bleaching and treatment of the pulp is basically attained by passing the pulp through a fluffer to produce a fluffed pulp, forming a uniform pulp bed from the fluffed pulp and passing the gaseous reaction medium through the pulp bed. In embodiments of the invention, the pulp is refined to single fibers. As shown in FIG. 1, the apparatus 10 comprises a fluffer or refiner 12, a reactor 14 in the form of a reaction tower and a distribution device 16 for distributing the pulp substantially uniformly across the diameter of the reactor to form a uniform bed height and depth in reactor 14. The pulp being treated by the process can be a chemical, mechanical or waste paper pulp.

The fluffer 12 is a defibrator having a pair of opposing grinding plates located within a comminution chamber. The fluffer 12 can be a defibrator having a structure similar to that disclosed in U.S. Pat. No. 4,913,358 to Sbaschnigg et al. and U.S. Pat. No. 5,314,583 to Kappel, which are hereby incorporated by reference. The fluffer 12 includes a fixed grinding plate 18 and a rotating grinding plate 20 which is driven by a motor 22. The fixed grinding plate 18 is movable in a direction toward the rotating grinding plate 20 to selectively adjust the space in the comminuting chamber. The fluffer 12 can be cooled or heated by means of a fluid on the stationary and rotating grinding plates. In embodiments, the fluffer is cooled by introducing a cooling fluid such as water through cooling chambers in the housing. The fluffer 12 fluffs and refines the fiber bundles to single fibers.

In preferred embodiments as shown in FIG. 1, the grinding plates 18, 20 are oriented vertically so that the pulp passing through the fluffer 12 is directed radially outward from the plates and downward into the reactor 14. In alternative embodiments, the grinding plates can be oriented horizontally. The vertical orientation of the grinding plates as shown is generally preferred when the fluffer 12 can be positioned directly above the reactor 14 since the pulp exiting the fluffer 12 can be directed downwardly into the reactor 14 without the need for a carrier gas to convey the fluffed pulp.

A screw feeder 24 is coupled to the fluffer 12 to feed the pulp continuously to the fluffer 12. The pulp is supplied to the screw feeder 24 through a chute 26. In preferred embodiments, the screw feeder 24 includes an inlet port 28 to supply the gaseous reaction medium to the pulp in the screw feeder.

Figure 1A:
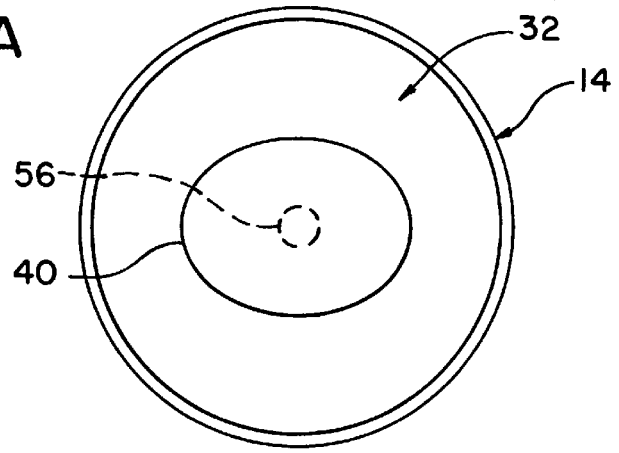
FIG. 1A is a top plan view of the distributing device of FIG. 1.
Figure 1B:
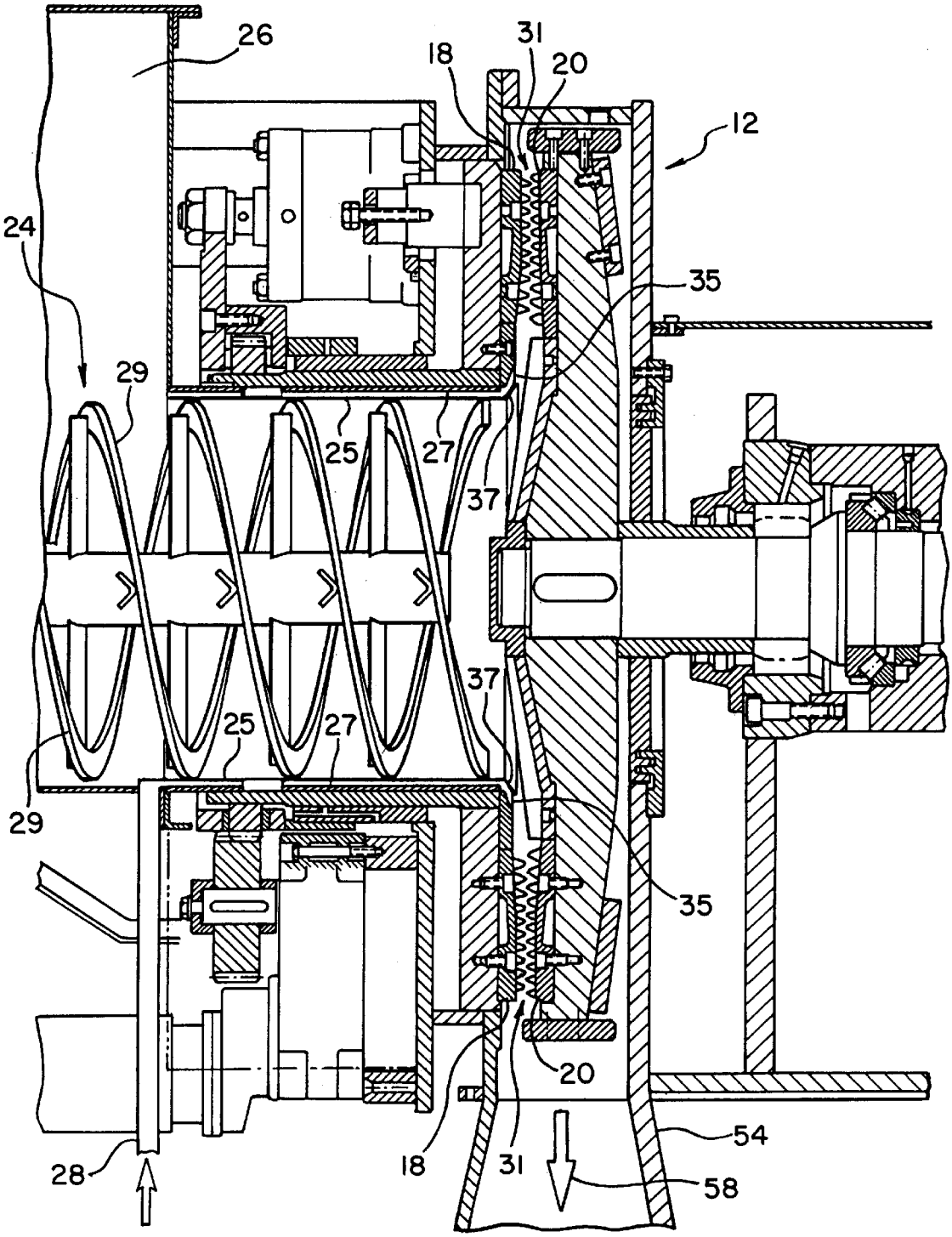
FIG. 1B is a partial cross-sectional view of the fluffer in an embodiment of the invention showing the grinding plates, pulp inlet and gaseous reaction inlet.

Referring to FIG. 1B, the fluffer 12 according to a preferred embodiment of the invention is illustrated in cross-section showing screw feeder 24 and grinding plates 18, 20. As shown, the screw feeder 24 includes a double walled barrel 25 defining an annular space 27 around the screw 29. The annular space 27 terminates at the exit end 35 of the barrel 25 between the grinding plates 18, 20. The structure and operation of this fluffer is disclosed in WO 94/27713 which is incorporated by reference. The pulp is fed through screw feeder 24 coaxially with respect to the axis of the rotating grinding plate 20. The gaseous reaction medium, such as ozone, is fed through inlet port 28, passes through the annular space 27 and exits at 35 adjacent the fixed grinding plate 18 at the upstream end of the fluffing zone 31. As shown, the opposing surfaces of the grinding plates 18, 20 define a fluffing and comminuting zone 31. The pulp and reaction medium are contacted and mixed together as they enter the fluffing and comminuting zone 31. The barrel 25 includes a conical shaped collar 37 to direct the reaction medium radially outwardly through the comminuting zone. In this fashion, the pulp and reaction medium are contacted with each other and fed simultaneously through the fluffing and comminuting zone 31 to produce a fluffed, refined and partially reacted pulp. In this embodiment, little or no reaction takes place in the screw feeder.

In alternative embodiments, the inlet port 28 is positioned at the upstream end of the screw feeder 24 adjacent the pulp inlet 30 to enable the pulp to mix with the reaction medium as both are conveyed co-currently to the feed inlet of the fluffer 12. The position of the inlet port 28 is coordinated with the length of the screw feeder 24, the type of pulp, and the reaction medium to promote proper reaction conditions and reaction times in the screw feeder. The residence time in the screw feeder is sufficient to initiate the reaction without over bleaching the outer surface of the pulp particles. In preferred embodiments, the gaseous reaction medium is added with the pulp at an inlet of the fluffer so that the pulp and reaction medium are fed together co-currently to the comminuting chamber of the fluffer 12. When the reaction medium is ozone, the rate of reaction is very high so that the ozone is added with the pulp 28 to mix with the pulp and initiate the bleaching reaction on the pulp particles as the pulp enters the fluffing zone. Reactants which have a rate of reaction less than ozone can be mixed with the pulp in the screw feeder. Generally, ozone is not mixed with the pulp for long periods of time before entering the fluffer to avoid non-uniform bleaching of the pulp.

In the process of the invention, the pulp is supplied to the screw feeder 24 while the reaction medium is introduced through the inlet port 28 where it is directed to the fluffer. The pulp and reaction medium are then fed together co-currently to the inlet of the fluffing zone of the fluffer 12 where pulp is comminuted and fluffed while in continuous contact with the reaction medium to produce a partially treated or reacted pulp. The fluffed pulp and reaction medium are dispensed to the reactor 14 and distribution device 16 to form a uniform bed height where the gaseous reaction medium then passes uniformly through the bed 32.

Referring to FIG. 1, a gas reaction medium, such as oxygen or an oxygen and ozone mix, also can be fed in further embodiments into this fluffer 12 through an inlet 38 in the housing of the fluffer. In this embodiment, the reaction gas can be added near the grinding plates 18, 20 and mixed into the pulp as the pulp is being separated into single fibers. The pulp mixture, consisting of separated fibers and a reaction gas medium, in which part of the reaction between the gas and the surface of the fibers has already taken place, is then directly fed into the pulp reactor 14 or bleaching tower.

The reactor 14 has the shape of a cylindrical tower having a height and width sufficient to treat a suitable volume of pulp as known in the art. The reactor 14 includes a pulp inlet 30 in the upper portion thereof and a pulp outlet 52 at the bottom. As shown in FIG. 1, the pulp inlet 30 is positioned in the center of the reactor and spaced vertically above the distribution device 16. A chute 54 extends from the fluffer 12 to the inlet 30 to guide the pulp from the fluffer into the reactor.

The pulp exiting the fluffer 12 drops downwardly onto a rotating distribution disc 40 of distribution device 16, which, as shown, is on an incline. The pulp strikes the disc 40 and is distributed from there onto the surface of the pulp bed 32. The fluffed pulp striking the rotating disc 40 is distributed substantially uniformly across the diameter of the reactor 14 and the upper surface 76 of the pulp bed 32. The loose distribution of the pulp and the separated fibers result in a pulp bed 32 having good permeability to ensure efficient gas contact with the pulp and prevent channeling of the gas through the pulp bed. The rotating distribution disc 40 prevents a cone shape from forming in the pulp bed 32 as shown by phantom line 33 in FIG. 1, and the resulting disadvantages of uneven permeation of the pulp material by the gaseous reaction medium. The gas permeates the uniform bed of pulp material evenly and reacts evenly with the surface of the individual fibers so that a uniform bleaching reaction is obtained without individual fibers being destroyed or overreacted due to excessive contact with the bleaching agent. The residual gas is collected in a double casing 42 of the reactor 16 and is removed through the outlet port 44. Any remaining gas withdrawn from the reactor 14 is destroyed and the residual oxygen recycled to produce additional ozone if desired. In further embodiments, the ozone removed from the reactor 14 is recycled directly to the inlet 28 of the screw feeder 24. The ozone or other gaseous reaction agent can be cooled to 40° C. or less before recycling to cool the pulp and the screw feeder or fluffer.

The reacted and treated pulp is discharged at the bottom end of the reactor 14 or bleach tower by a discharge device 46. In embodiments, dilution water is added through inlet 47 to the outlet to dilute the pulp suspension to a low or medium consistency of approximately 3–15 wt %. This resulting pulp suspension is fed to a further treatment stage of the pulp process by a pump 48 as known in the art.

The distribution device 16 includes a vertically oriented shaft 56 which is preferably centered in the reactor and directly below the pulp inlet 30. The shaft 56 is coupled to the rotating discharge device 46 so that the shaft 56 rotates with the discharge device 46. Discharge device 46 includes a plurality of vanes 59 spaced from the bottom wall of the reactor 14 to sweep the pulp to the outlet 52. A motor 61 drives the discharge device 46 and the shaft 56 at a selected speed to attain the desired discharge rate and residence time of the pulp in the reactor. The screw feeder 24 and fluffer 12 are operated at a speed complementing the speed of the discharge device 46 to maintain a constant pulp level in the reactor 14.

In the embodiment of FIGS. 1 and 1A, distribution device 16 is a disc-shaped device 40 mounted on the upper end of the shaft 56. The disc 40 is fixed at an incline below the inlet 30 to distribute the pulp around the pulp bed 32. The angle of the disc 40 with respect to the shaft 56 is selected in relation to the pulp being processed, the speed of rotation of the disc 40 and the dimension of the reactor 14. In the embodiment shown in FIGS. 1 and 1A, disc 40 is positioned at about 30° to the horizontal. The actual dimension of the disc 40 is selected to uniformly distribute the pulp across the diameter of the reactor 14. In the embodiment shown, the disc 40 is a circular shaped disc having a diameter about one-half the diameter of reactor 14 and pulp bed 32.

The fluffed pulp exiting the fluffer 12 essentially free-falls through an atmosphere of the gaseous reaction medium in the chute 54 and reactor 14 above the distribution device 16 to ensure contact of the pulp fibers with the gaseous reaction medium. The fluffed pulp then strikes the rotating distribution device 16 and is deflected radially around surface 76 of the pulp bed 32. The gaseous reaction medium is generally introduced a short distance upstream of the fluffer or directly into the fluffer and flows downwardly through the pulp bed 32 as shown by arrows 58. In further embodiments, additional reaction medium can be introduced to reactor 14 through an inlet 60 at the upper end or inlet 62 at the lower end when a counter-current gas flow through the reactor 14 is desired.

The reactor 14 is a static bed reactor such that the pulp bed moves downwardly through the reactor as the pulp is discharged from the bottom. Preferably, the reactor includes no agitation device to reform, mix or alter the pulp bed after it is formed.

In preferred embodiments of the invention, the permeability of the pulp bed 32 in the pulp reactor 14 corresponds to an approximate pressure loss of less than 0.02 bar per meter of height of the pulp, preferably less than 0.001 bar per meter, and most preferably less than 0.0002 bar per meter of pulp height. Maintaining a high permeability by a suitable fluffer allows the gaseous reaction medium to flow readily through the pulp bed without high energy consumption and without undesirable channeling of the reaction medium through the pulp bed.

The bulk density of the fluffed and refined pulp 32 in the pulp reactor 14 is typically between 30 and 170 kg per $m^3$, preferably between 50 and 150 kg per $m^3$. In one embodiment, the bulk density is about 120 kg per $m^3$. The low bulk density of the pulp provides sufficient space between the individual fibers to allow the gaseous reaction medium, such as ozone, to flow between the fibers, thus providing homogeneous permeation of the pulp fibers by the gaseous reaction medium.

The gaseous reaction medium is passed through the pulp bed 32 at a speed of between 5 and 500 mm per second in relation to the overall cross section, and preferably between 10 and 100 mm per second. The permeation speed of the gaseous reaction medium provides an optimum contact period between the gaseous medium and the pulp, as well as a suitable retention time in the reactor 14.

The fluffed and refined pulp entering the reactor 14 is distributed evenly over the surface of the pulp bed 32 in the reactor. The substantially uniform distribution of the pulp provides a uniform flow resistance of the pulp bed 32 and avoids undesirable channeling of the gaseous reaction medium through the bed. The uniform distribution also prevents some fibers from not contacting the gaseous medium, while preventing others from being damaged by excessive contact with the gaseous medium. The uniform distribution of the fluffed pulp on the pulp bed 32 ensures a uniform contact of the pulp fibers by the gaseous reaction medium and a uniformly treated pulp.

The uniform treatment of the pulp bed 32 by the gaseous reaction medium is provided by maintaining a substantially uniform height or depth across the entire width of the pulp bed. In preferred embodiments, the center 34 or the highest point of the pulp bed 32 is no more than 0.2 times higher than the depth at the outer radius 36 or lower point of the surface of the pulp bed 32. The best results are achieved with the height difference of the pulp bed layer within this range.

It is generally preferred that the pulp be a high consistency pulp having a consistency between about 20 and about 60 wt %. Pulp consistency within this range provides a high efficiency process.

The pulp preferably has the Kappa number being between 1 and 20 when the pulp enters the screw feeder 24 and fluffer 12. A kraft pulp has an initial Kappa number of about 3–20, and preferably about 7–12. A sulfite pulp has a Kappa number of about 2–8, while a waste paper pulp has a Kappa number of about 1–10. In some instances, such as a dissolved pulp, the initial Kappa No. can be as low as 1. The Kappa No. of the pulp discharged from the reactor 14 decreases 1–15 and preferably 3–10 units from the starting Kappa No. Approximately 50% of the Kappa reduction occurs in the fluffer with the remaining reduction occurring in the reactor 14.

The pulp entering the screw feeder and fluffer 12 preferably has a brightness between about 35 and 80% ISO or more, preferably about 45–60% ISO. Generally, brightness values are about 40–65% ISO for kraft pulp, about 60–80%

ISO for sulphite pulp, and about 50–80% ISO for waste paper. The brightness of the pulp upon leaving the reactor 14 is usually increased 2–30%, and preferably 5–20% compared with brightness of the incoming pulp. Typically, about 50% of the increase in brightness occurs in the screw feeder and fluffer with the remaining increase occurring in the reactor 14. The actual increase in brightness depends on various factors including the initial brightness and ozone concentration. Generally, the brightness of the pulp increases about 1–15% ISO and preferably 2–10% ISO in the fluffer.

The viscosity of the pulp is preferably as high as possible since the viscosity is a means of estimating the length of the cellulose fibers. A decrease in viscosity is usually a good indication of degradation of the cellulose fibers. Degradation can occur during pulp digestion, oxygen delignification and ozone bleaching. It is important to minimize the fiber degradation in the process and apparatus of the invention. In preferred embodiments of the invention, the pulp being fed to the fluffer has a viscosity of about 900 to 1500 $dm^3/g$ (SCAN) for softwoods and about 700 to 1400 $dm^3/g$ (SCAN) for hardwoods. The viscosity generally drops about 50 to 300 $dm^3/g$ in the ozone stage depending on the initial viscosity. Generally, the higher the initial viscosity, the greater the drop in the ozone stage.

The pH of the pulp is preferably maintained low since ozone is unstable at high pH. Since a very low pH may also attack the fibers, the pH is maintained in the range of about 2–6, and preferably about 2–4 during the ozone treatment.

The gaseous reaction medium is preferably mixed with the pulp in the fluffer 12 before the reactor 14. In this manner, the gaseous reaction medium reacts immediately with the fiber surfaces as the pulp is being fluffed, thus achieving a homogenous reaction. The gaseous reaction medium further can be added to the pulp bed in the reactor into the gas area above or below the pulp bed. When additional gaseous reaction medium is added to the reactor, the gaseous medium can be added in a counter-current or co-current manner.

The gaseous reaction medium in preferred embodiments is ozone in a suitable carrier gas such as air or oxygen. The ozone concentration in the carrier gas is generally about 3–5% by volume to provide effective pulp bleaching. In further embodiments, the gaseous reaction medium can be hydrogen peroxide, oxygen, nitrogen oxides or other known reaction agents at standard concentrations.

The height or depth of the pulp bed to the diameter of the pulp bed generally has a ratio of more than 0.5, preferably more than 1. This ratio of the height to the diameter ensures an optimum permeability cross section with suitable retention times for the gaseous reaction medium and the pulp. The reactor 14 is dimensioned to accommodate the bed height and diameter.

The reactor 14 also includes a distribution device 16 to ensure uniform feed and distribution of the pulp onto the pulp bed 32 and to provide an even and uniform pulp bed surface. The distribution device 16 provides a uniform pulp bed height and prevents the fiber bundles which are broken down in the fluffer 12 from agglomerating and forming large fiber bundles. The uniform pulp bed permits homogeneous permeation and treatment of the pulp by the gaseous medium.

A further feature of the invention is the distribution device connected to the discharge device of the reactor, and rotating along with the discharge device. Thus, there is no need for an additional drive, and the rotating movement of the distribution device is coordinated with the discharge rate of the pulp.

Figure 2A:
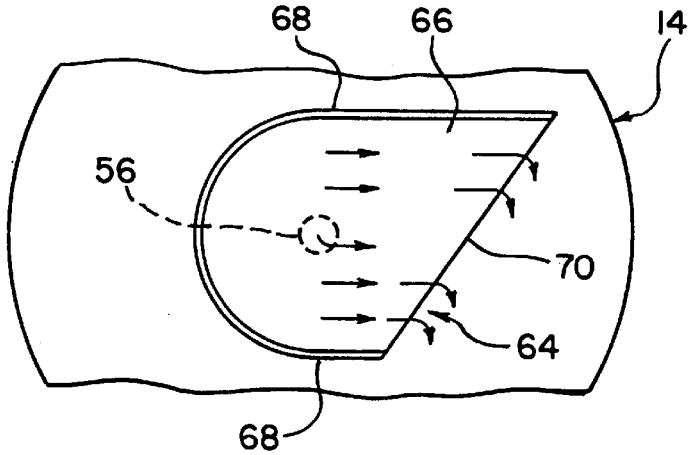
FIG. 2A is a top plan view of the distribution device of FIG. 2.
Figure 2:
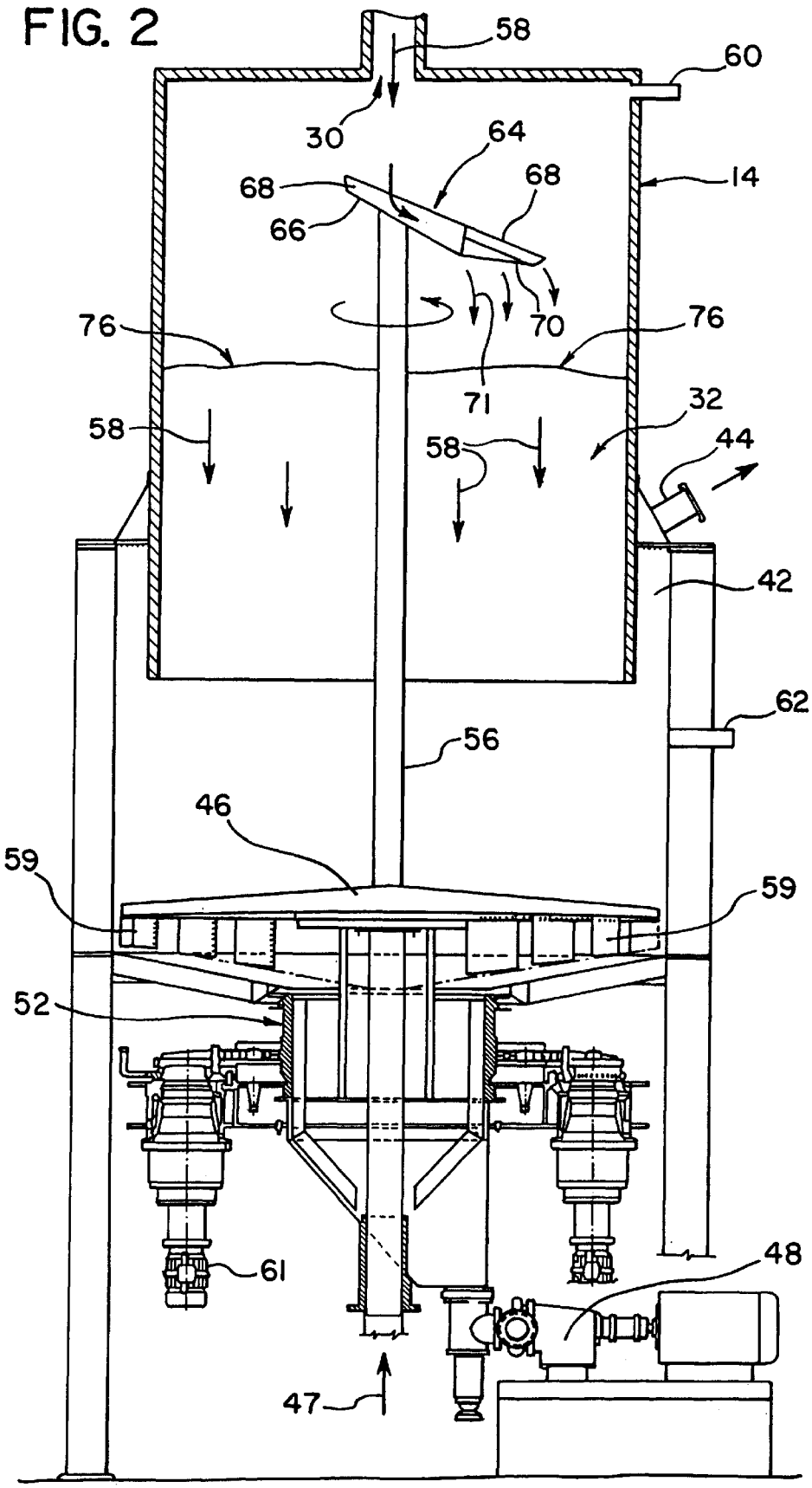
FIG. 2 is a cross-sectional view of the reactor in a second embodiment showing the rotating distribution device.

FIG. 2 shows an alternative embodiment of the distribution device in the reactor. The reactor is essentially the same as the reactor of FIG. 1, so that like elements are identified by the same reference number. A fluffer (not shown) and an inlet 31 for the pulp and gaseous reaction medium as in the embodiment of FIG. 1 are included. The distribution device as shown is attached to the rotating shaft 56 extending upwardly from the discharge device and rotates simultaneously with the shaft. The distribution device is in the form of an inclined chute 64 having a bottom wall 66 and side walls 68 to direct the pulp outwardly as the device rotates. As shown in FIG. 2A, the chute has an outer edge 70 extending diagonally between the side walls 68. The diagonal outer edge 70 promotes a uniform radial distribution of the fluffed pulp across the diameter of the upper surface 76 of the pulp bed 32 as shown by the arrows 71.

The angle of incline, size and rotational speed of the chute 64 are tailored for the type of pulp being treated. Factors which are taken into consideration in selecting the chute include, for example, the pulp density, viscosity, consistency and whether the pulp is a chemical, mechanical, or waste paper pulp. In addition, the height and width of the reactor and the pulp bed affect the design of the distribution device to obtain a uniform bed height of the pulp bed.

Figure 3A:
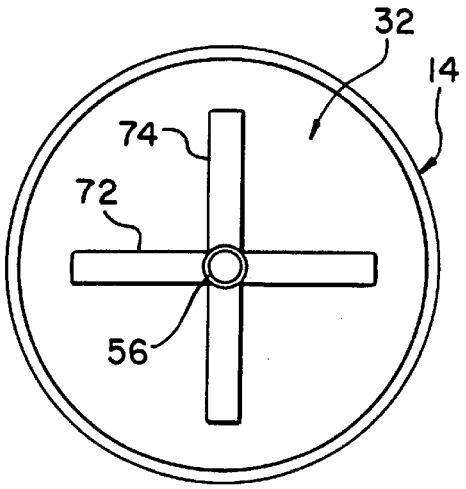
FIG. 3A is a top plan view of the distribution device of FIG. 3.
Figure 3:
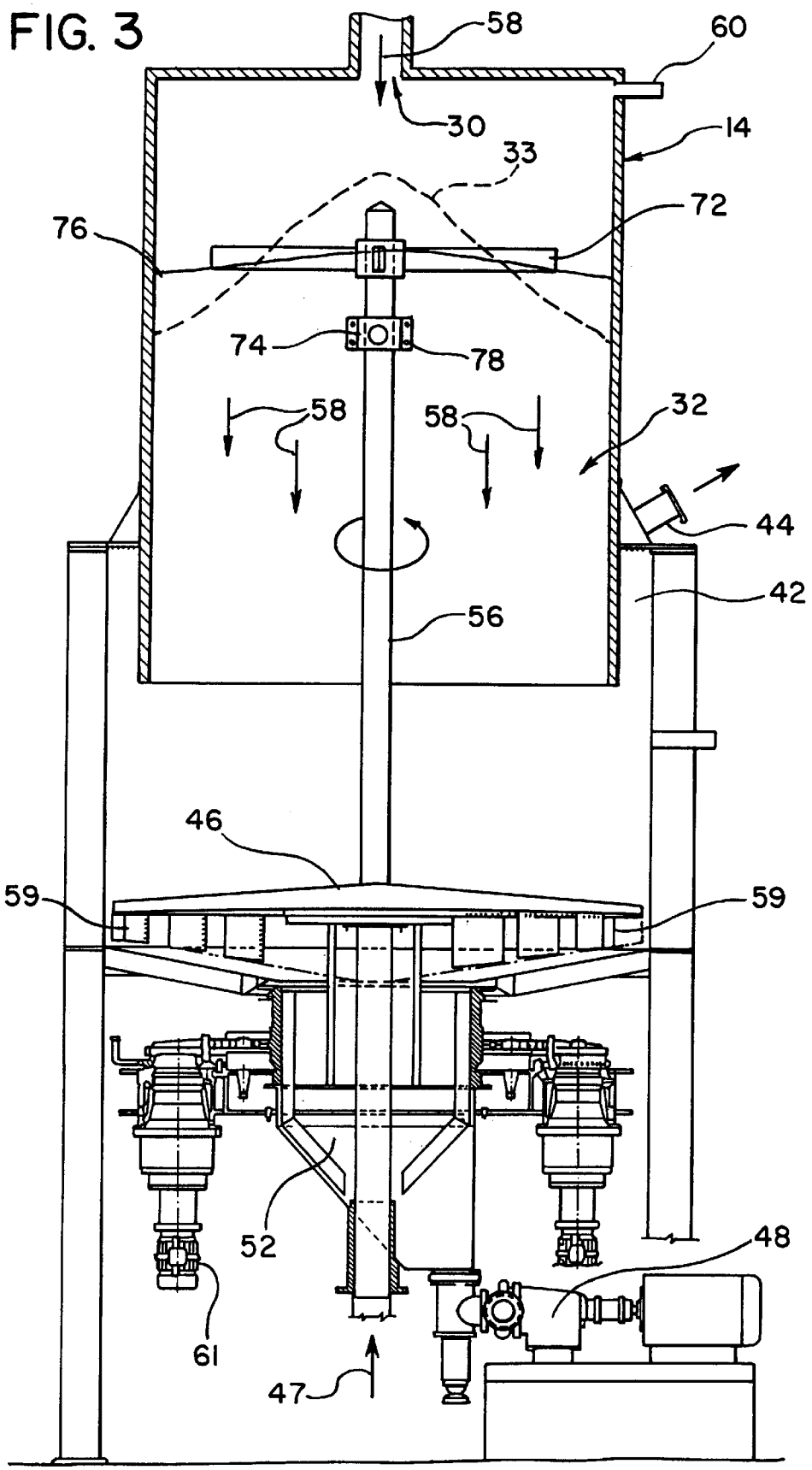
FIG. 3 is a cross-sectional view of the reactor showing the distribution device in a third embodiment.

FIGS. 3 and 3A show a further embodiment of the distribution device in the reactor 14. A fluffer and reaction medium inlet (not shown) are provided in a similar manner to the embodiment of FIG. 1. As in the previous embodiments, the distribution device is coupled to the vertical shaft 56 which is coupled to the discharge device 46. In this embodiment, the distribution device 16 includes at least one and preferably two arms 72 and 74 extending horizontally outward from the shaft 56. In the embodiment shown, the two arms 72, 74 are spaced axially along the shaft 56 and are positioned substantially perpendicular to each other. The arms 72, 74 have a width and length complementing the dimensions of the reactor 14 to rake the pulp outwardly and produce a pulp bed having a substantially uniform height. Arms 72, 74 have a length about 60% to 80% of the radius of the reactor 14. The width of the arms generally increases the smoothing effect on the pulp bed, but increases power consumption required to rotate the arms. The pulp is introduced to the reactor 14 through the inlet 30 at the upper end and falls downwardly onto the distribution device. In the absence of the distribution device, the pulp normally falls to form a cone shape 33 as shown in phantom lines. The distribution device rakes the pulp to a substantially level surface 76 as shown in FIG. 3.

In preferred embodiments, the upper arm 72 is positioned at the desired pulp height, while the lower arm 74 is positioned below the surface 76. The arms 72, 74, as shown, are coupled to the shaft 56 by bolts 78 so that the position of the arms 72, 74 on the shaft 56 can be adjusted. In this manner, the height of the arms 72, 74 and the spacing between the arm can be selected. The arms are rotated at a speed to maintain a smooth upper surface and uniform pulp bed depth. For example, a rotation speed is generally about 0.2 to 2 rpm for a high consistency pulp and about 3 to 10 rpm for a medium consistency pulp.

Figure 4A:
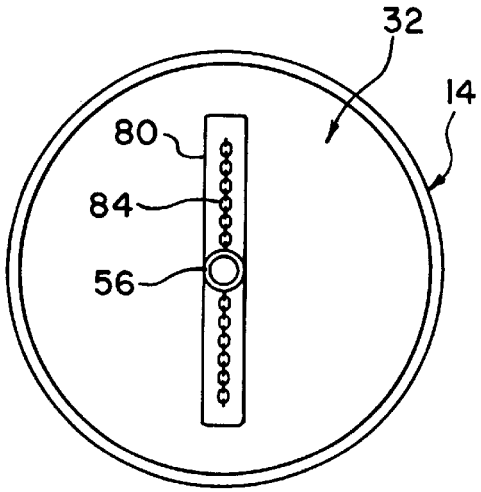
FIG. 4A is a top plan view of the distribution device of FIG. 4.
Figure 4:
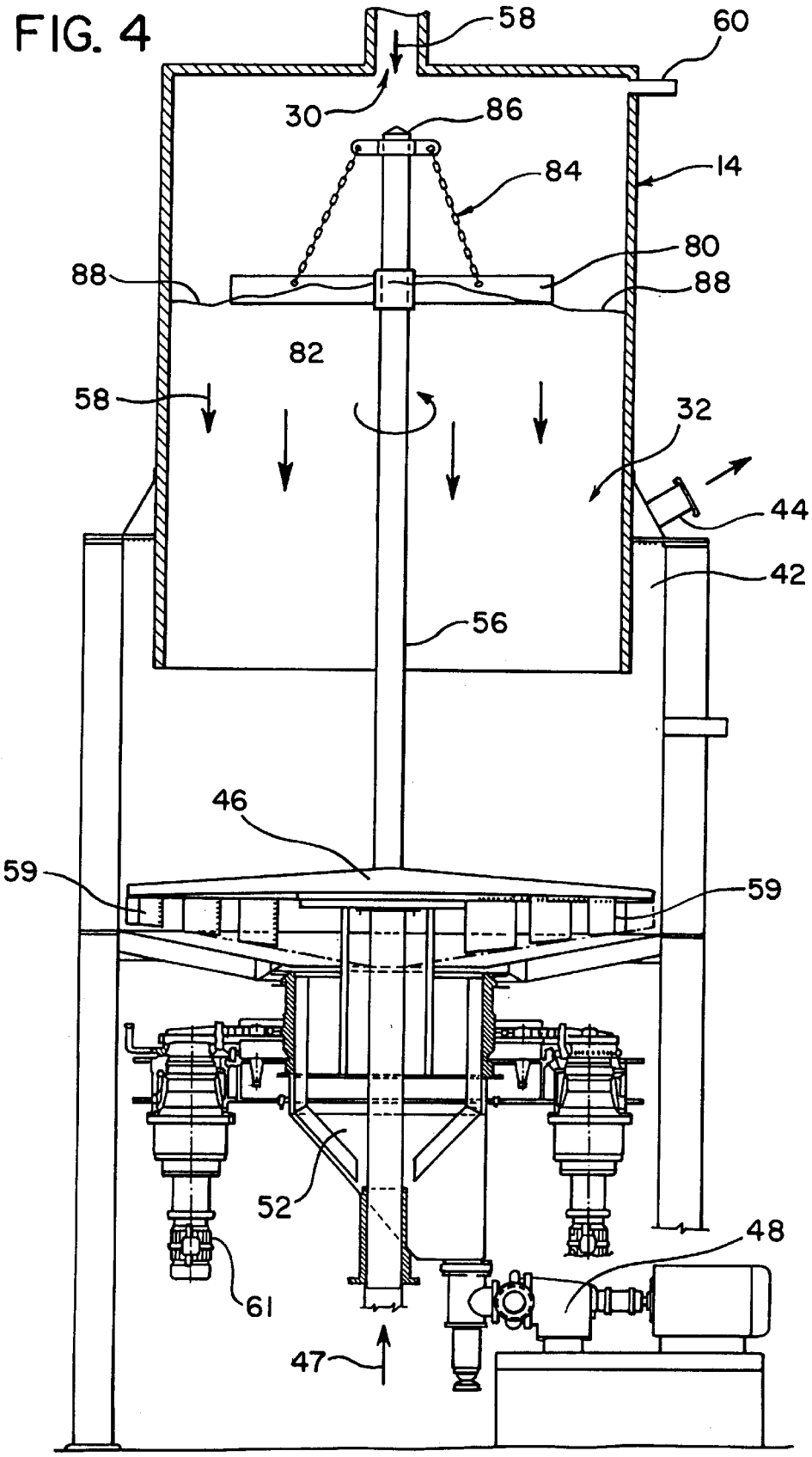
FIG. 4 is a cross-sectional view of the reactor showing the distribution device in a fourth embodiment.

FIGS. 4 and 4A show a further embodiment of the distribution device in the pulp reactor. A fluffer (not shown) and reaction medium and pulp inlet 30 are provided in a similar manner to the embodiment of FIG. 1. In this embodiment, the distribution device is a cross beam 80 having a central hub 82. The shaft 56 extending upward from the discharge device 46 passes through the hub 82 so that hub 82 and cross beam 80 are slidable on the shaft 56. A flexible coupling device 84 extends from the upper end 86 of the shaft 56 and is coupled to the cross beam 80. The cross beam 80 is supported by the flexible device 84 which can be, for example, chains or cables. As the shaft 56 rotates, the resistance of the cross beam 80 on the pulp material 88 causes the flexible device 84 to twist around the shaft 56 and raise the height of the cross beam 80 with respect to the shaft 56 and the pulp material 88. In this manner, the height of the cross beam 80 changes with changes in the pulp bed height. As in the previous embodiments, the cross beam 80 rakes the pulp to produce a substantially uniform pulp height. The weight and dimension of the beam 80 and the attachment point of the flexible coupling device determine the efficiency of the smoothing effect on the pulp bed.

The apparatus according to the invention ensures a uniform pulp bed, and the fluffed and refined pulp enables the treating gas to effectively and uniformly contact the surfaces of the fibers and produce a uniformly treated pulp. The uniformity of treatment and gas contact is particularly important in the bleaching of pulp with oxygen, ozone or other bleaching agents.

While various embodiments have been selected to illustrate the invention, it will be understood by those skilled in the art that various changes and modifications can be made therein without departing from the scope of the invention as defined in the appended claims.

What is claimed is:

1. A process for treating pulp with a gaseous reaction medium comprising the steps of:

feeding a substantially uniform mixture of a gaseous reaction medium and a pulp to a fluffer upstream of a fluffing zone, and passing said gaseous reaction medium and pulp in admixture through said fluffing zone in said fluffer to produce a partially reacted, fluffed pulp, wherein said fluffer is positioned directly above a static bed reactor, discharging said partially reacted fluffed pulp downwardly from said fluffer to free fall through said gaseous reaction medium in a chute and into said pulp static bed reactor through a pulp inlet at the top of said reactor onto a distribution means, and distributing said pulp substantially uniformly in said reactor to form a pulp bed having a substantially uniform and homogeneous upper surface and bed depth, said reactor having a rotating distribution means for distributing said fluffed pulp substantially uniformly across the entire diameter of said reactor and upper surface of said pulp bed, wherein said distribution means is disposed in said reactor and vertically spaced below said pulp inlet of said reactor, and passing a gaseous reaction medium uniformly through said pulp bed.

2. The process according to claim 1, wherein said fluffed pulp has a bulk density of between about 30 and 170 kg per $m^3$.

3. The process according to claim 1, comprising passing said gaseous reaction medium through said pulp bed at a gas speed between 5 and 500 mm per second in relation to the overall cross section of said pulp bed.

4. The process according to claim 1, comprising contacting said pulp and gaseous reaction medium to form an admixture and feeding said admixture to a pulp inlet of said fluffer.

5. The process according to claim 1, comprising forming said pulp bed having a depth at the center of said bed of 0.2 times or less its depth at an outer radius.

6. The process according to claim 1, wherein said pulp has a consistency of 20 wt % to 60 wt %.

7. The process according to claim 1, wherein said pulp has a Kappa number between 1 and 20 before introducing to said pulp bed reactor and wherein said pulp has a Kappa number after passing through said pulp bed reactor being lower than upon entry thereto.

8. The process according to claim 1, wherein said pulp has a brightness between 40 and 80% ISO upon entry to said pulp bed reactor and discharging said pulp from said pulp bed reactor having a higher brightness than said pulp introduced to said pulp bed reactor.

9. The process according to claim 1, wherein said pulp is selected from the group consisting of chemical pulp, mechanical pulp and waste paper pulp.

10. The process according to claim 1, comprising adding additional gaseous reaction medium to said reactor and passing said medium through said pulp bed.

11. The process according to claim 1, comprising forming said pulp bed having a depth to diameter ratio of at least 0.5.

12. The process of claim 1, wherein said gaseous reaction medium is an ozone-containing gas.

13. The process of claim 12, further comprising introducing said ozone-containing gas together with said pulp into said fluffer.

14. The process of claim 1, comprising passing a gaseous reaction medium counter-currently through said pulp bed.

15. The process of claim 1, wherein said distribution means is an inclined disc and said process comprises rotating said disc to distribute said pulp.

16. The process of claim 1, wherein said distribution means is a rotating inclined chute and said process comprises rotating said chute to distribute said pulp.

17. The process of claim 1, wherein said distribution means is a rotating horizontal bar, said process comprising rotating said horizontal bar across said surface of said pulp bed to distribute said pulp substantially across the radius of said reactor.

18. The process of claim 1, comprising introducing said pulp and reaction medium to said fluffer together to said fluffing zone and refining said pulp to single fibers in the presence of said reaction medium.

19. A process for treating pulp with a gaseous reaction medium comprising the steps of:

feeding a substantially uniform mixture of a gaseous reaction medium and a pulp to a fluffer upstream of a fluffing zone, and passing said gaseous reaction medium and pulp in admixture through said fluffing zone in said fluffer to produce a partially reacted, fluffed pulp, discharging said fluffed pulp downwardly through a chute and pulp inlet at the top of a pulp static bed reactor and onto a distribution means for distributing said pulp substantially uniformly in said reactor to form a pulp bed having a substantially uniform and homogeneous upper surface and bed depth, said reactor having a rotating distribution means vertically braced below said pulp inlet for distributing said fluffed pulp substantially uniformly across the entire diameter of said reactor and upper surface of said pulp bed, and to form said pulp bed having a permeability corresponding to a pressure loss of less than 0.02 bar per m of bulk material height, and passing a gaseous reaction medium uniformly through said pulp bed.

* * * * *